US008413976B2

(12) United States Patent
Hattori et al.

(10) Patent No.: US 8,413,976 B2
(45) Date of Patent: Apr. 9, 2013

(54) IMAGE FORMING SYSTEM, SHEET FINISHER, AND FOLDING METHOD

(75) Inventors: Hitoshi Hattori, Tokyo (JP); Naohiro Kikkawa, Kanagawa (JP); Shuuya Nagasako, Kanagawa (JP); Takashi Saito, Kanagawa (JP); Naoyuki Ishikawa, Kanagawa (JP); Yuusuke Shibasaki, Kanagawa (JP); Hidetoshi Kojima, Miyagi (JP); Naoki Oikawa, Miyagi (JP); Go Aiba, Miyagi (JP)

(73) Assignee: Ricoh Company Limited, Tokyo (JP)

( * ) Notice: Subject to any disclaimer, the term of this patent is extended or adjusted under 35 U.S.C. 154(b) by 42 days.

(21) Appl. No.: 13/067,276

(22) Filed: May 20, 2011

(65) Prior Publication Data

US 2011/0301005 A1 Dec. 8, 2011

(30) Foreign Application Priority Data

Jun. 4, 2010 (JP) ..... 2010-128921
Jan. 26, 2011 (JP) ..... 2011-014404

(51) Int. Cl.
*B31F 1/08* (2006.01)
*B31F 1/26* (2006.01)

(52) U.S. Cl.
USPC ..... 270/45; 270/32; 270/58.07

(58) Field of Classification Search ..... 270/32, 270/45, 58.07; 493/23, 396, 397, 398, 399, 493/400
See application file for complete search history.

(56) References Cited

U.S. PATENT DOCUMENTS

| | | | | |
|---|---|---|---|---|
| 7,597,311 | B2 * | 10/2009 | Kawata et al. | 270/37 |
| 7,770,876 | B2 * | 8/2010 | Sasahara | 270/32 |
| 7,891,647 | B2 * | 2/2011 | Nakane et al. | 270/52.09 |
| 2008/0258372 | A1 * | 10/2008 | Nakane et al. | 270/58.08 |
| 2009/0062096 | A1 * | 3/2009 | Sasahara | 493/396 |
| 2010/0258994 | A1 | 10/2010 | Kikkawa et al. | |
| 2010/0303585 | A1 | 12/2010 | Asami et al. | |
| 2010/0310340 | A1 | 12/2010 | Suzuki et al. | |
| 2011/0064541 | A1 | 3/2011 | Kikkawa et al. | |

FOREIGN PATENT DOCUMENTS

| | | | |
|---|---|---|---|
| JP | 60262771 | A | 12/1985 |
| JP | 2008081258 | A | 4/2008 |

OTHER PUBLICATIONS

Abstract of JP 60-262771 published Dec. 26, 1985.
Abstract of JP 2008-081258 published Apr. 10, 2008.

* cited by examiner

*Primary Examiner* — Leslie A Nicholson, III
(74) *Attorney, Agent, or Firm* — Harness, Dickey & Pierce, P.L.C.

(57) ABSTRACT

An image forming system includes: a folding unit that folds a sheet of paper to form a fold in the sheet; a creasing unit that, before the sheet is folded, produces a crease in the sheet at a fold position where the fold is to be formed; a crease-position adjusting unit that adjusts a crease position where the crease is to be produced; a fold-position adjusting unit that adjusts the fold position; a first input unit that receives an input specifying an amount, by which the crease position is to be adjusted; and a second input unit that receives an input specifying an amount, by which the fold position is to be adjusted, wherein when the fold position is adjusted by the second input unit, the crease position is also adjusted in synchronization with the adjustment of the fold position.

10 Claims, 15 Drawing Sheets

IMAGE FORMING SYSTEM, SHEET FINISHER, AND FOLDING METHOD

CROSS-REFERENCE TO RELATED APPLICATIONS

The present application claims priority to and incorporates by reference the entire contents of Japanese Patent Application No. 2010-128921 filed in Japan on Jun. 4, 2010 and Japanese Patent Application No. 2011-014404 filed in Japan on Jan. 26, 2011.

BACKGROUND OF THE INVENTION

1. Field of the Invention

The present invention relates to an image forming system, a sheet finisher, and a folding method.

2. Description of the Related Art

What is called saddle-stitched or center-folded booklet production has been conventionally performed. The saddle-stitched booklet production is performed by saddle stitching a sheet batch, which is a stack of a plurality of sheets delivered from an image forming apparatus, and folding the thus-saddle-stitched sheet batch in the middle of the sheet batch. Folding such a sheet batch containing a plurality of sheets can cause outside sheets of the sheet batch to be stretched at a fold line by a greater amount than inside sheets. Image portions at the fold line on outside sheets can thus be stretched, resulting in damage, such as come off of toner, to the image portions in some cases. A similar phenomenon can occur when other fold, such as z-fold or tri-fold, is performed. A sheet batch can be folded insufficiently depending on the thickness of the sheet batch.

Creasing devices that produces a crease (scoring) in a sheet batch prior to a folding process where the sheet batch undergoes single fold or the like so that even outside sheets can be readily folded and thereby preventing come off of toner have already been known. Such creasing devices typically produce a crease in a sheet in a direction perpendicular to a sheet conveying direction by moving a roller on a sheet, burning a sheet with a laser beam, pressing a creasing blade against a sheet, or a like method.

An example of such a creasing device is disclosed in Japanese Patent Laid-open Application No. 2008-081258. A technique that allows a roller for use in forming a crease to be interchangeable with an optimum roller suited for paper to be creased so that a crease of a favorable shape and high accuracy can be produced according to a type of the paper is disclosed in Japanese Patent Laid-open Application No. 2008-081258.

Meanwhile, a crease is useless unless the crease is produced on the same position as the position of a fold, which is to be formed through folding subsequent to creasing. Hence, it is required to cause a crease (score) position and a fold position to coincide with each other. If the crease position fails to coincide with the fold position, a double crease or an unfavorable result that sheet edges on the side opposite from the crease are not flush can occur. Aside from this, a crease and a fold are formed at a desired position in a sheet in some cases. More specifically, to perform half fold or center fold (saddle stitching), for instance, it is required to cause a fold position and a stitch position to coincide with each other at a center portion of a sheet in a longitudinal direction.

FIG. 27 and FIG. 28 are explanatory diagrams illustrating an example where a fold position, a crease (score) position, and an intended position (a position where a sheet is to be folded) depart from one another. If, as illustrated in FIG. 27, although it is desired to fold a sheet of paper (hereinafter, "sheet") P at an intended position (a center position in a sheet conveying direction) F1, a crease is produced at a crease position F2 and a actual fold is actually formed at a fold position F3, and the sheet P is folded at the fold position F3, the crease position F2 departs from the intended position F1 as illustrated in FIG. 28. Furthermore, when the sheet having a left edge FL and a right edge FR as illustrated in FIG. 27 is folded, the overlaid edges fail to be flush with each other, resulting in an edge misalignment FX, which is a misalignment between the left edge FL and the right edge FR.

Such an edge misalignment makes not only creasing useless but also causes an unnecessary crease to be left. To avoid this, when performing creasing, the following adjustments are preferably performed.

1) Causing a crease position and a fold position to coincide with each other.

2) Causing creasing and folding to be performed at a predetermined position in a sheet.

Meanwhile, in a situation where a sheet undergoes post-processing operations, sheet-position adjustment is preferably performed because positions where the post-processing operations are performed typically depart from each other. To perform the adjustment 1) and the adjustment 2) mentioned above, a unit for adjusting the crease position and a unit for adjusting the fold position are required, respectively. However, it is burdensome and less efficient to perform the adjustment 1) to cause the crease position and the fold position to coincide with each other and additionally perform the adjustment 2) to adjust the crease position and the fold position independently.

SUMMARY OF THE INVENTION

It is an object of the present invention to at least partially solve the problems in the conventional technology.

According to an aspect of the present invention, there is provided an image forming system including: a folding unit that folds a sheet of paper to form a fold in the sheet; a creasing unit that, before the sheet is folded, produces a crease in the sheet at a fold position where the fold is to be formed; a crease-position adjusting unit that adjusts a crease position where the crease is to be produced; a fold-position adjusting unit that adjusts the fold position; a first input unit that receives an input specifying an amount, by which the crease position is to be adjusted; and a second input unit that receives an input specifying an amount, by which the fold position is to be adjusted, wherein when the fold position is adjusted by the second input unit, the crease position is also adjusted in synchronization with the adjustment of the fold position.

According to another aspect of the present invention, there is provided a sheet finisher comprising: a folding unit that folds a sheet of paper to form a fold in the sheet; a creasing unit that, before the sheet is folded, produces a crease in the sheet at a fold position where the fold is to be formed; a crease-position adjusting unit that adjusts a crease position where the crease is to be produced; a fold-position adjusting unit that adjusts the fold position; a first input unit that receives an input specifying an amount, by which the crease position is to be adjusted; and a second input unit that receives an input specifying an amount, by which the fold position is to be adjusted, wherein when the fold position is adjusted by the second input unit, the crease position is also adjusted in synchronization with the adjustment of the fold position.

According to still another aspect of the present invention, there is provided A folding method to be performed by a sheet finisher including a folding unit that folds a sheet of paper to form a fold in the sheet, and a creasing unit that, before the sheet is folded, produces a crease in the sheet at a fold position where the fold is to be formed, the folding method comprising: adjusting, when adjustment of the fold position is performed, also a creasing position where the crease is to be produced in synchronization with the adjustment of the fold position; and adjusting, when adjustment of the crease position is performed, only the crease position.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
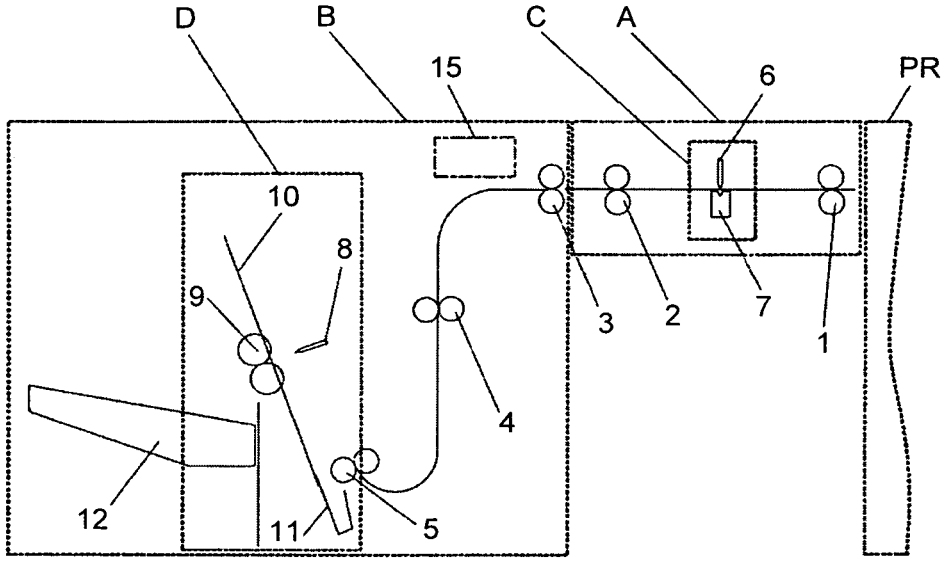
FIG. 1 is a diagram illustrating a schematic configuration of an image forming system according to an embodiment of the present invention.

According to an aspect of the present invention, adjustment of a crease position and adjustment of a fold position can be performed with a smaller number of operations and readily by allowing adjustment of the crease position to be performed in synchronization with and concurrently with adjustment of the fold position.

In the embodiments discussed below, a center-folding mechanism D is an example of the folding unit; a creasing mechanism C is an example of the creasing unit; a first conveying unit 1 and a second conveying unit 2 are an example of the crease-position adjusting unit; a trailing-edge fence 11 is an example of the fold-position adjusting unit; a CPU A1 and a control panel 20 are an example of the first input unit and the second input unit; a control panel 15, 20 is an example of the selection unit; communications interfaces A3 and A4 are an example of the information communications unit; a crease-position adjustment screen 30, a fold-position adjustment screen 40, and a selection screen 50 on the control panel 20 are each an example of the operating screen.

Exemplary embodiments of the present invention are described below with reference to the accompanying drawings.

FIG. 1 is a diagram illustrating a schematic configuration of an image forming system according to an embodiment of the present invention. The image forming system includes the image forming apparatus PR that forms an image on a sheet, the creasing device A that creases the sheet, and the folding device B that performs folding (post processing).

The creasing device A includes a first conveying unit 1, a second conveying unit 2, and the creasing mechanism C. The creasing mechanism C includes a creasing member 6 and a receiving body 7, and produces a crease by pinching a sheet between the creasing member 6 and the receiving body 7. The sheet creased in the creasing device A is conveyed to the folding device B downstream. The folding device B includes a third conveying unit 3, a fourth conveying unit 4, a fifth conveying unit 5, a center-folding mechanism D, and a stacking tray 12. In the present embodiment, conveying rollers are used as the conveying units.

The creasing device A includes the first and the second conveying units 1, 2 and the creasing mechanism C. The creasing mechanism C includes, as mentioned above, the creasing member 6 and the receiving body 7 and produces a linear crease by pinching a sheet between the creasing member 6 and the receiving body 7. The creasing member 6 includes, on an end surface facing the receiving body 7, a creasing blade (male blade; corresponding to a creasing blade C10, which will be described later) for use in producing a crease. The creasing blade extends linearly in a direction perpendicular to a sheet conveying direction. A distal end of the creasing blade is pointed like a blade. A creasing channel (female blade) is cut in a surface, which faces the creasing blade, of the receiving body 7. The creasing channel allows the creasing blade to be fitted thereinto. The creasing member 6 and the receiving body 7 have such shapes as discussed above; accordingly, when a sheet is pinched between them, these shapes of the distal end (the male blade) and the channel (the female blade) produce a crease in the sheet.

The folding device B includes the center-folding mechanism D that performs folding. The sheet creased in the creasing device A is conveyed into the folding device B, in which the third to the fifth conveying units 3, 4, and 5 deliver the sheet to the center-folding mechanism D.

The center-folding mechanism D includes a center-folding tray 10, the trailing-edge fence 11 provided at a lower end (most upstream in the conveying direction) portion of the center-folding tray 10, a folding plate 8, a pair of folding rollers 9 for folding a sheet along a crease, and the stacking tray 12. The trailing-edge fence 11 evens up sheet edges in the sheet conveying direction by causing a return roller (not shown) to be forcibly pressed against trailing edges of sheets delivered onto the center-folding tray 10. A jogger fence (not shown) also evens up sheet edges in the direction perpendicular to the conveying direction.

The folding plate 8 presses its distal-end edge against the crease in the evened-up sheet batch, thereby pushing the crease into a nip between the pair of folding rollers 9. The sheet batch pushed into the nip between the pair of folding rollers 9 is creased in the nip. When saddle-stitching is to be performed, the sheet batch is stitched by a stitching device (not shown) at a creased portion, and thereafter subjected to this folding process, what is called half fold. The half-folded sheet batch is delivered onto and stacked on the stacking tray 12.

Figure 2:
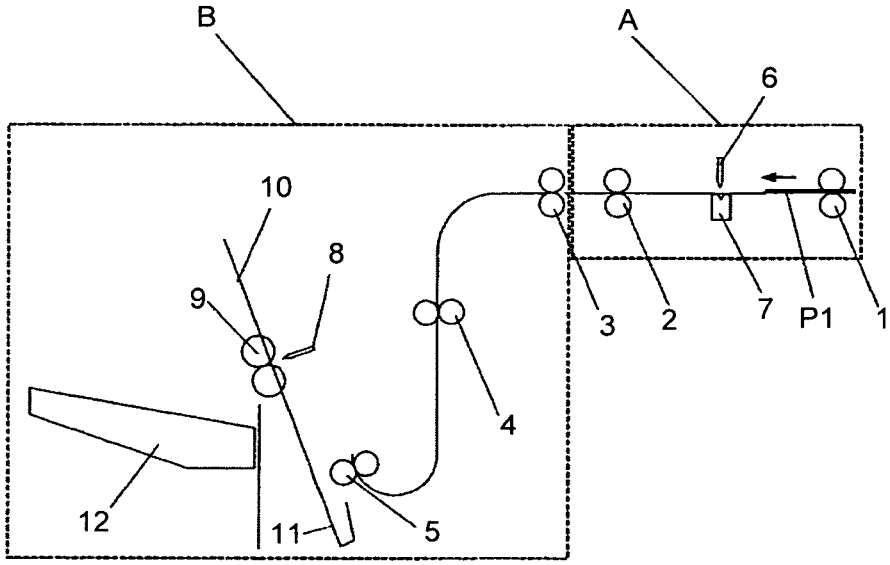
FIG. 2 is a schematic explanatory diagram of a series of operations, including folding, performed in the image forming system and illustrating a state where a sheet is conveyed into a creasing device.
Figure 3:
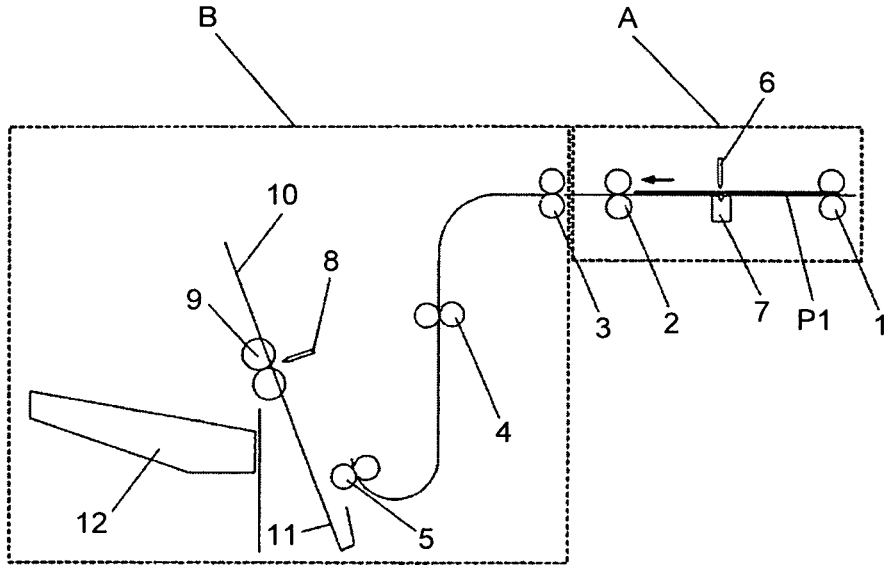
FIG. 3 is a schematic explanatory diagram of the series of operations, including folding, performed in the image forming system and illustrating a state where a leading edge of the sheet has been conveyed to a position immediately upstream of downstream ones of conveying rollers.
Figure 4:
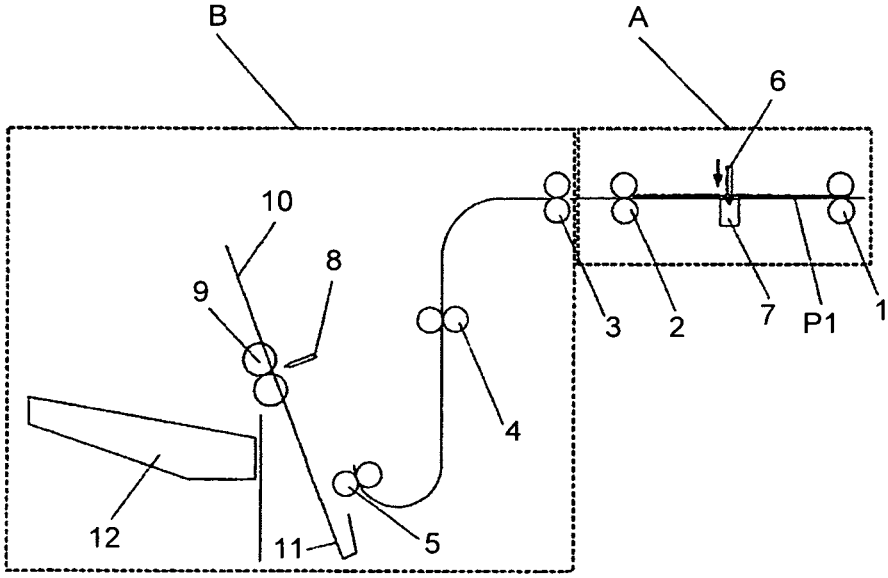
FIG. 4 is a schematic explanatory diagram of the series of operations, including folding, performed in the image forming system and illustrating a state where creasing is being performed.
Figure 5:
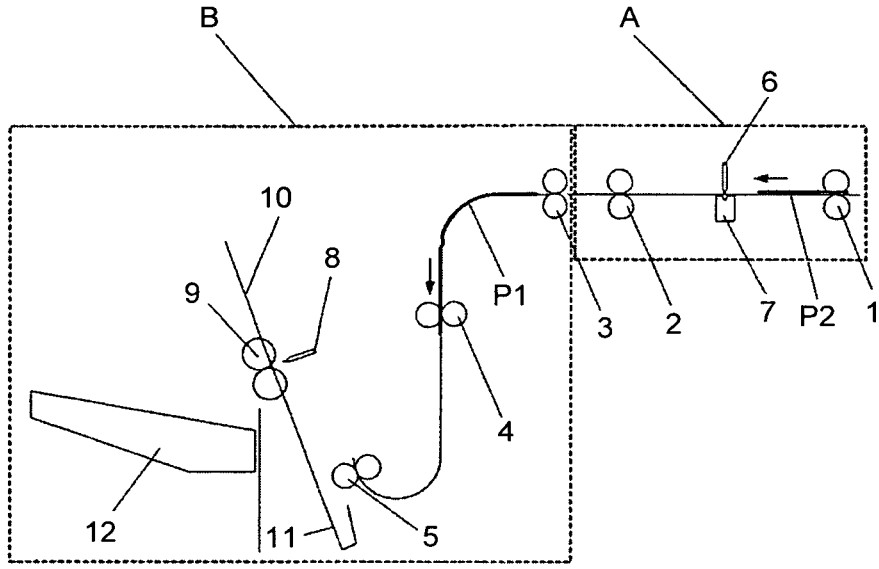
FIG. 5 is a schematic explanatory diagram of the series of operations, including folding, performed in the image forming system and illustrating a state where the creased sheet has been delivered into a folding device and a second sheet is conveyed into the creasing device.

FIG. 2 to FIG. 12 are schematic explanatory diagrams of a series of operations, including folding, to be performed in the image forming system. In this image forming system, a sheet P1, on which an image has been formed by the image forming apparatus PR, is conveyed into the creasing device A and stopped at a position where a crease is to be produced (FIG. 2 and FIG. 3). When the sheet P1 is stopped at a position where a leading edge of the sheet P1 has abutted on the nip in the second conveying unit 2 as illustrated in FIG. 4, the creasing member 6 is lowered to pinch the sheet P1 between the creasing member 6 and the receiving body 7. More specifically, the sheet P1 is pinched between the creasing blade and the female blade with a predetermined pressure. This produces a crease in the sheet P1 (FIG. 4).

Figure 6:
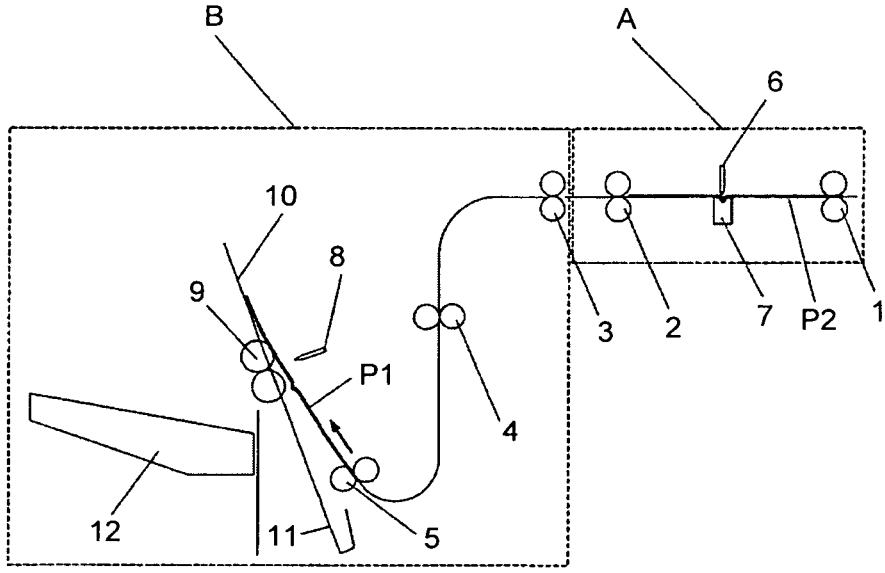
FIG. 6 is a schematic explanatory diagram of the series of operations, including folding, performed in the image forming system and illustrating a state where the second sheet stopped at a creasing position is being creased.
Figure 7:
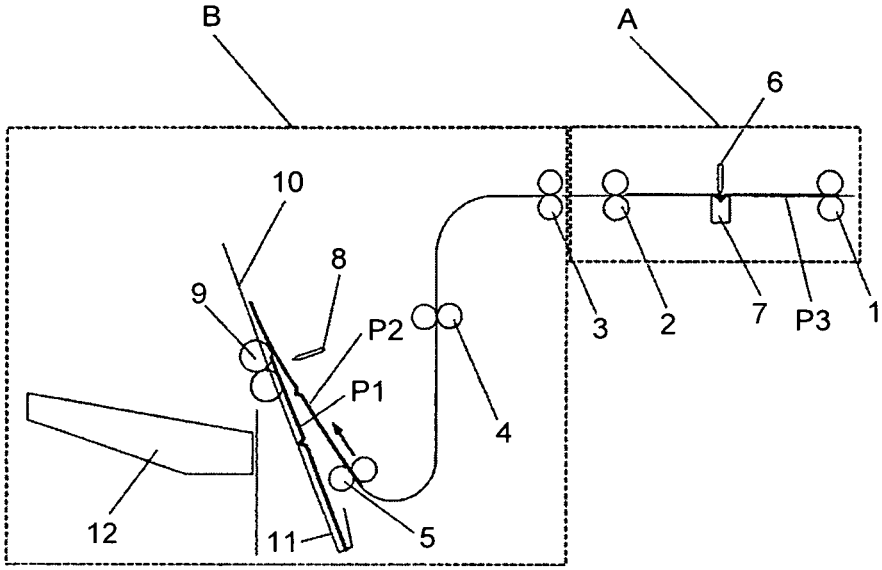
FIG. 7 is a schematic explanatory diagram of the series of operations, including folding, performed in the image forming system and illustrating a state where a third sheet is being creased.
Figure 8:
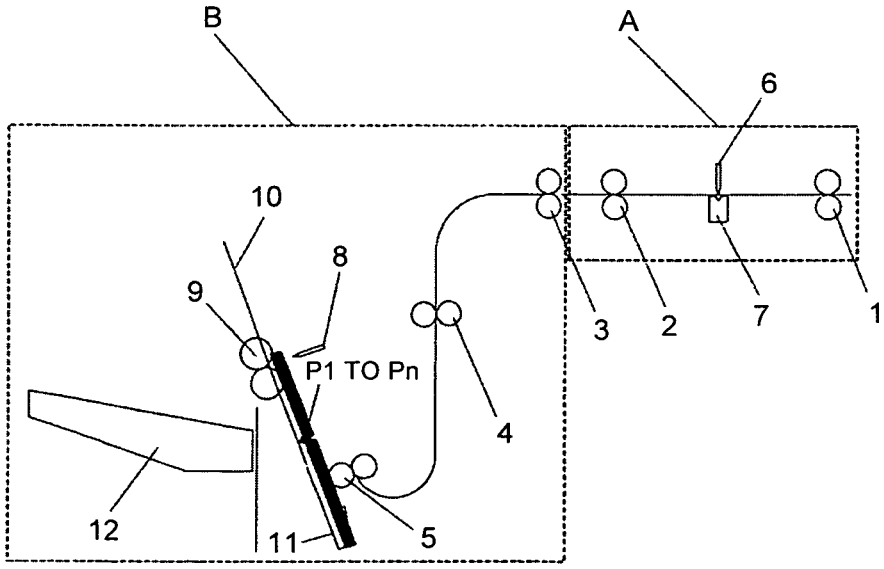
FIG. 8 is a schematic explanatory diagram of the series of operations, including folding, performed in the image forming system and illustrating a state where a last sheet has been stacked on a center-folding tray.
Figure 9:
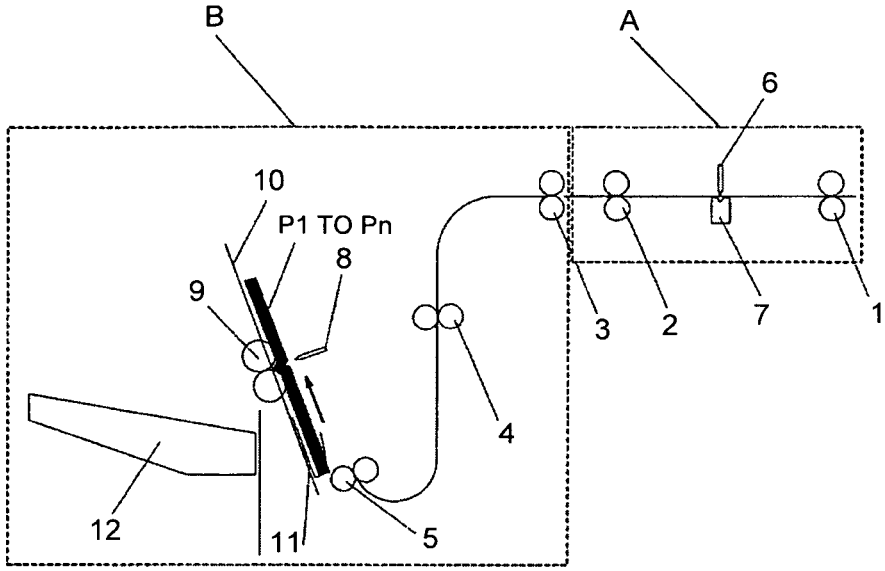
FIG. 9 is a schematic explanatory diagram of the series of operations, including folding, performed in the image forming system and illustrating a state, subsequent to the state of FIG. 8, where a sheet batch has been moved to a center-fold position.
Figure 10:
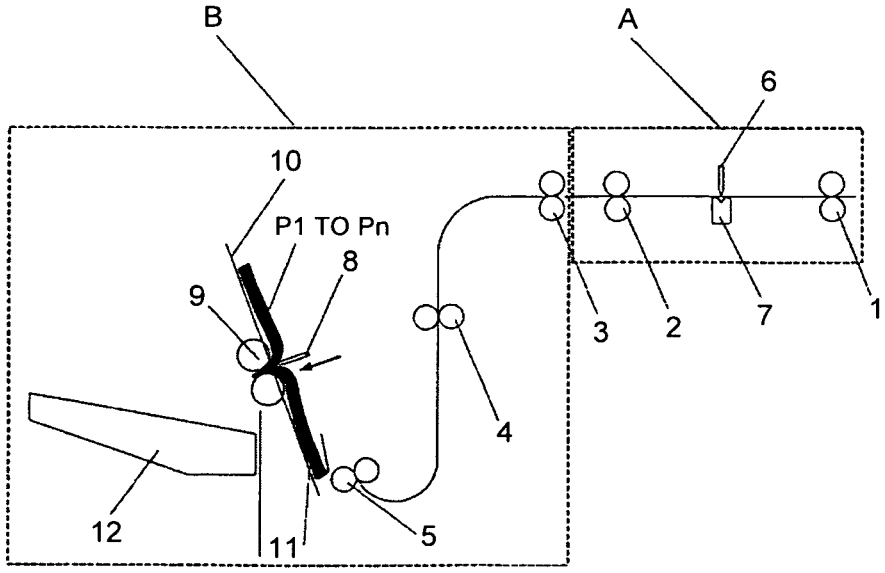
FIG. 10 is a schematic explanatory diagram of the series of operations, including folding, performed in the image forming system and illustrating a state, subsequent to the state of FIG. 9, where the sheet batch is being center-folded.
Figure 11:
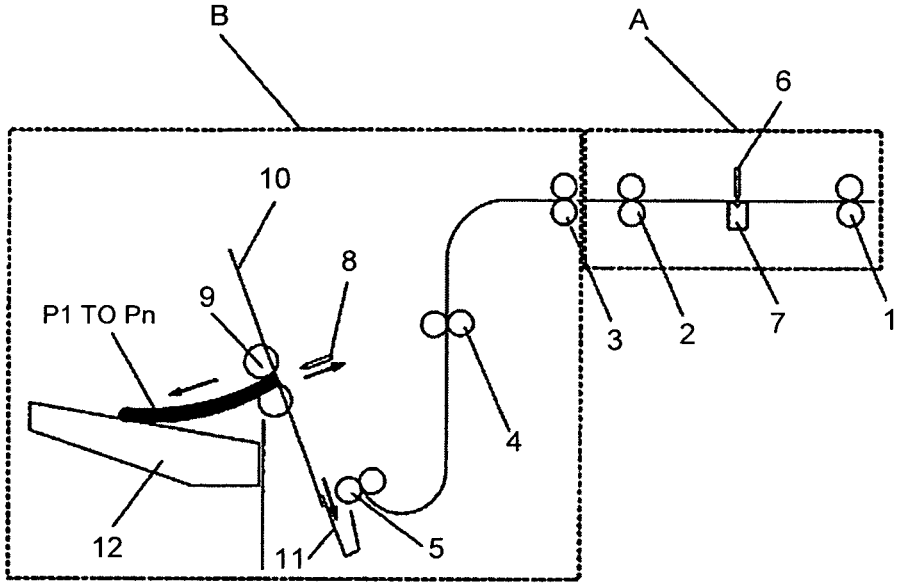
FIG. 11 is a schematic explanatory diagram of the series of operations, including folding, performed in the image forming system and illustrating a state where the sheet batch is delivered while undergoing center folding performed by folding rollers.
Figure 12:
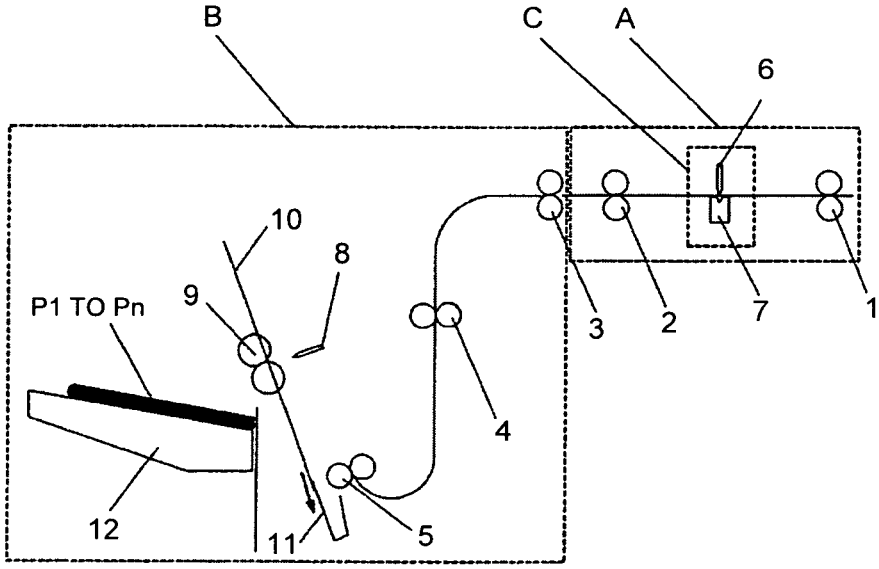
FIG. 12 is a schematic explanatory diagram of a series of operations, including folding, performed in the image forming system and illustrating a state where the center-folded sheet batch has been delivered onto a stacking tray.

Thereafter, the thus-creased sheet P1 is conveyed to the folding device B (FIG. 5) and temporarily stored in the center-folding tray 10 (FIG. 6). The operations mentioned above are repeatedly performed for a predetermined number of sheets (FIG. 7). When a sheet batch containing a predetermined number of sheets (P1 to Pn) has been stored in the center-folding tray 10 (FIG. 8), the trailing-edge fence 11 lifts up the sheet batch to position the sheet batch to the folding position (FIG. 9). Thereafter, the folding plate 8 is moved to press against the creases in the sheets and push the creases into the nip between the pair of folding rollers 9, thereby performing folding (FIG. 10). The thus-folded sheet batch is delivered onto the stacking tray 12 (FIG. 11 and FIG. 12). This process for producing a single sheet batch is repeatedly performed for a predetermined number of sheet batches; the sheet batches are sequentially stacked on the stacking tray 12.

In the present embodiment, a function of adjusting a crease position (position adjustment) and a function of adjusting a folding position (position adjustment) are provided. By performing these functions, a crease position and a fold position are caused to coincide with each other. As illustrated in FIG. 9, when being folded, a sheet batch is positioned to a fold position by the trailing-edge fence 11. Accordingly, the fold position can be adjusted by changing the amount of travel of the trailing-edge fence 11.

In the present embodiment, a folding device that performs center folding is used as an example of the folding device; however, other known folding device that performs folding of a plurality of folds, such as tri-fold, Z-fold, double parallel fold, and closed-gate fold, can be used as the folding device as well.

Figure 13:
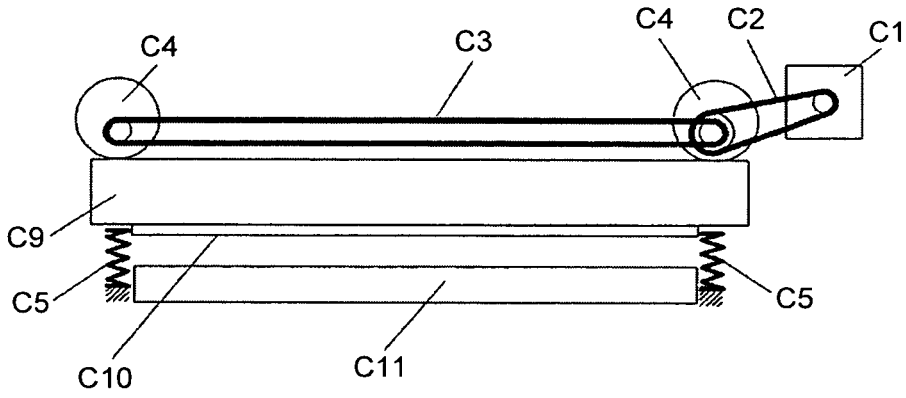
FIG. 13 is a diagram of a schematic configuration of a creasing mechanism and illustrating a state where the creasing blade has ascended to a highest position corresponding to a sheet receiving position.
Figure 14:
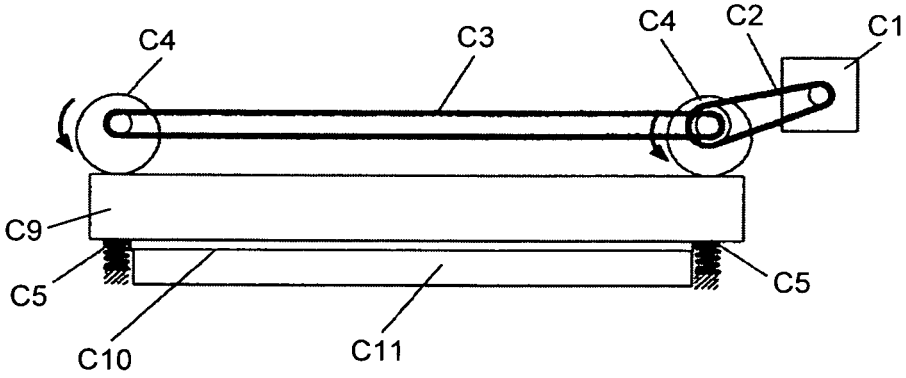
FIG. 14 is a diagram of a schematic configuration of the creasing mechanism and illustrating a state where the creasing blade has been lowered to a lowest position corresponding to a sheet creasing position.

FIG. 13 and FIG. 14 are diagrams each illustrating a schematic configuration of the creasing mechanism C. With reference to FIG. 13 and FIG. 14, the creasing member 6 of the creasing mechanism C includes a member C9 and the creasing blade C10. The member C9 and the creasing blade C10 are integrally rotated by a drive motor C1. The member C9 and the creasing blade C10 are integrally urged upward by a resilient member C5, bringing a top surface of the member C9 into sliding contact with cams C4. The cams C4, which are a pair of cams, are rotated by driving power transmitted from the drive motor C1 via a speed-reduction transmission mechanism C2 and a transmission mechanism C3. The cams C4, which are eccentric cams, are rotated in synchronization with each other, thereby moving up and down the creasing blade C10 integrally with the member C9.

Figure 15:
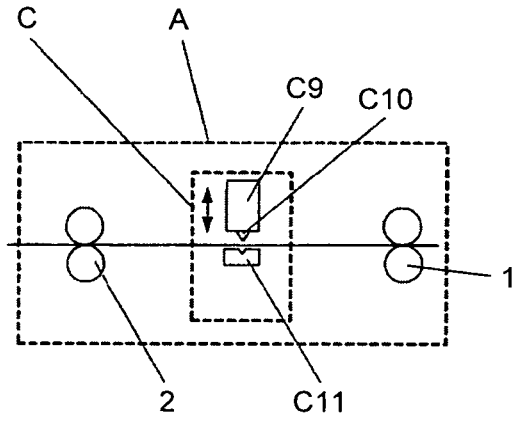
FIG. 15 is a schematic diagram of the creasing mechanism illustrated in FIG. 13 as viewed along a direction perpendicular to a sheet conveying direction.

A receiving body C11 is provided at a position facing the creasing blade C10. A crease is produced in a sheet by pinching the sheet between the creasing blade C10 and the receiving body C11. The receiving body C11 is a portion, including a channel portion at a top surface of the receiving body 7, of the receiving body 7. Referring to FIG. 13, a position where the creasing blade C10 has ascended uppermost corresponds to a sheet receiving position. Referring to FIG. 14, a position where the creasing blade C10 has descended lowermost corresponds to a sheet creasing position. FIG. 15 is a schematic diagram of the sheet of FIG. 13 as viewed in a direction perpendicular to the sheet conveying direction. During creasing illustrated in FIG. 4, a sheet is held in the nip in the first conveying unit 1. When a force is exerted on the sheet in a forward direction as the creasing blade C10 descends, the sheet is allowed to move in the forward direction by an action of a one-way clutch (not shown) provided on a shaft portion of the first conveying unit 1.

Figure 16:
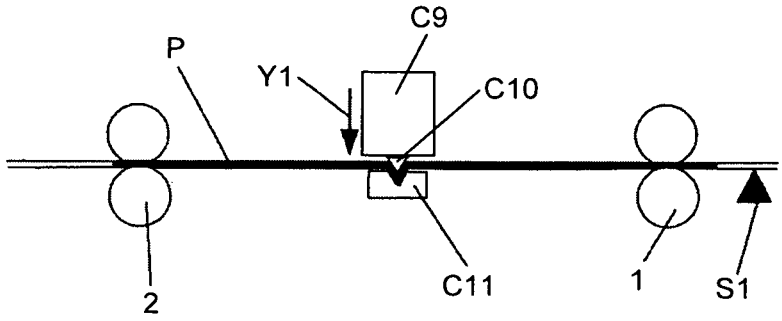
FIG. 16 is a schematic explanatory diagram of the operations of the creasing blade during creasing as viewed along the direction perpendicular to the sheet conveying direction and illustrating a state where the creasing blade has been lowered and producing a crease in the sheet.

FIG. 16 is a schematic explanatory diagrams of operations of the creasing blade during creasing as viewed along the direction perpendicular to the sheet conveying direction. In FIG. 16, reference numeral and symbol S1 denotes an entrance sensor for detecting a leading edge of the sheet P. The entrance sensor S1 detects a leading edge of a sheet conveyed into the creasing device A. The entrance sensor S1 is provided between the first conveying unit 1 on the upstream side and an entrance of the creasing device because a detection timing signal output from the entrance sensor S1 is used in subsequent control operations.

Figure 17:
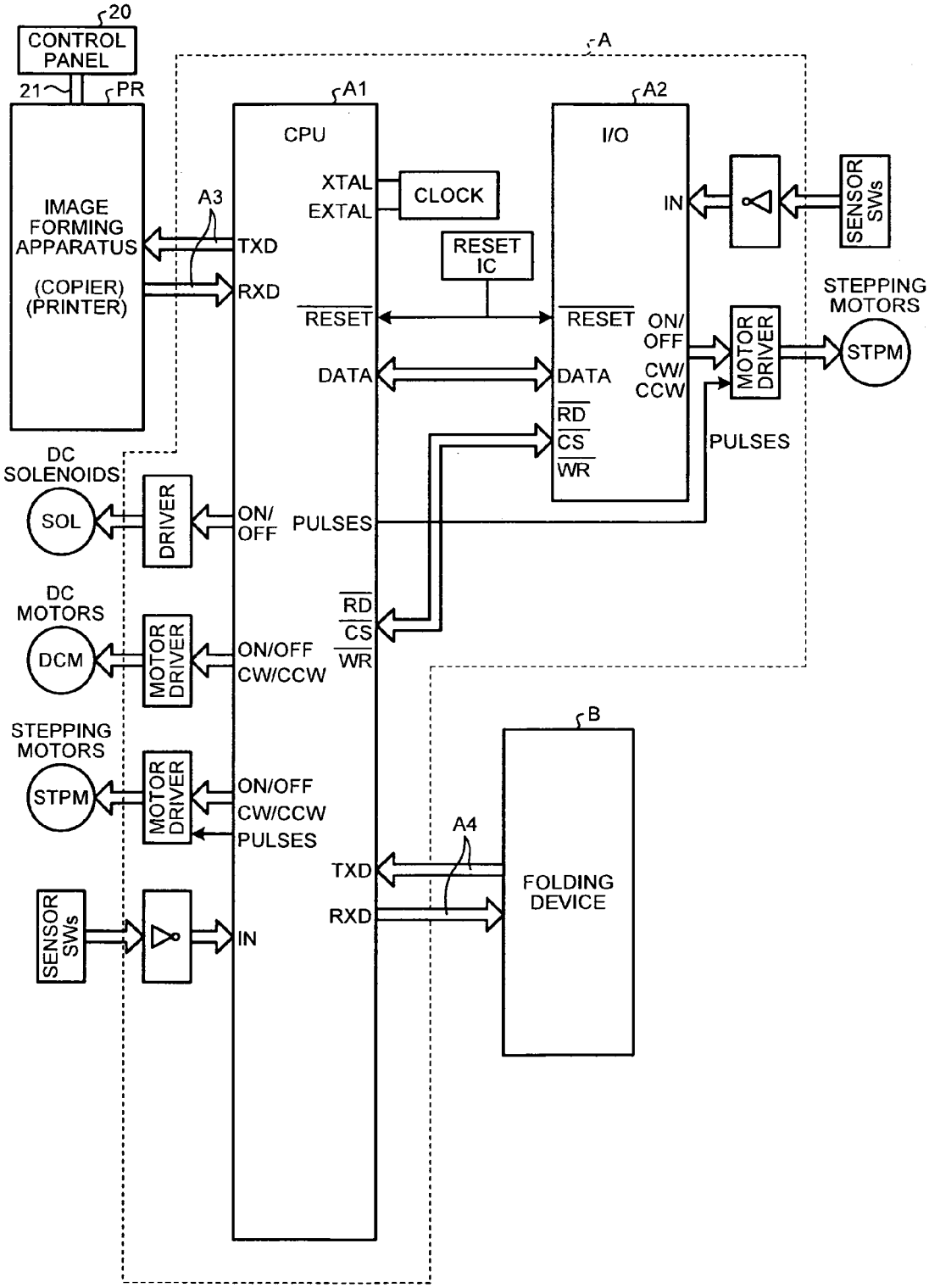
FIG. 17 is a block diagram illustrating a control structure of the image forming system including the creasing device, the folding device, and an image forming apparatus.

FIG. 17 is a block diagram illustrating a control structure of the image forming system including the creasing device A, the folding device B that performs folding, and the image forming apparatus PR. The creasing device A includes a control circuit equipped with a microcomputer including a central processing unit (CPU) A1 and an input/output (I/O) interface A2. Various signals are fed to the CPU A1 via a communications interface A3 from the CPU, various switches on a control panel 20, and various sensors (not shown) of the image forming apparatus PR. The CPU A1 performs predetermined control operations based on a thus-fed signal. The CPU A1 receives signals similar to those mentioned above from the folding device B via a communications interface A4 and performs predetermined control operations based on a thus-fed signal. The CPU A1 also performs drive control for solenoids and motors via drivers and motor drivers and obtains detection information from sensors in the device via the interface. The CPU A1 also performs drive control for motors via the I/O interface A2 and via motor drivers according to an entity to be controlled and sensors and obtains detection information from sensors. The CPU A1 performs the control operations discussed above by reading program codes stored in read only memory (ROM) (not shown), storing the program codes into random access memory (RAM) (not shown), and executing program instructions defined in the program codes by using the RAM as a working area and data buffer.

The creasing device A illustrated in FIG. 17 is controlled according to an instruction or information fed from the CPU of the image forming apparatus PR. An operating instruction is entered via the control panel 20 of the image forming apparatus PR by a user. The image forming apparatus PR and the control panel are connected to each other through a communications interface 21. Hence, an operation signal input via the control panel 20 is transmitted from the image forming apparatus PR to the creasing device A and to the folding device B. Operation status and functions of the devices A and B are indicated by using the control panel 20 for a user or an operator.

As illustrated in FIG. 16, the crease position is determined and adjusted by controlling conveyance distances of the first and the second conveying units 1 and 2. The position of the sheet P is adjusted based on step counts of a stepper motor that drives the first and the second conveying units 1 and 2 by using a timing signal output from the entrance sensor S1 on detection of a leading edge or a trailing edge of the sheet P as a trigger. Hence, a crease position relative to the sheet P is adjustable by changing amounts of rotation of the first and the second conveying units 1 and 2; a fold position is adjustable by changing the amount of travel of the trailing-edge fence 11 as discussed above.

As discussed above with reference to FIG. 27 and FIG. 28, when the desired fold position (hereinafter, "intended position") F1, the crease position F2, and the actual fold position F3 in the sheet P depart from one another, the edge misalignment FX results therefrom. How adjustment for preventing the edge misalignment FX is burdensome has already been discussed above.

Figure 18:
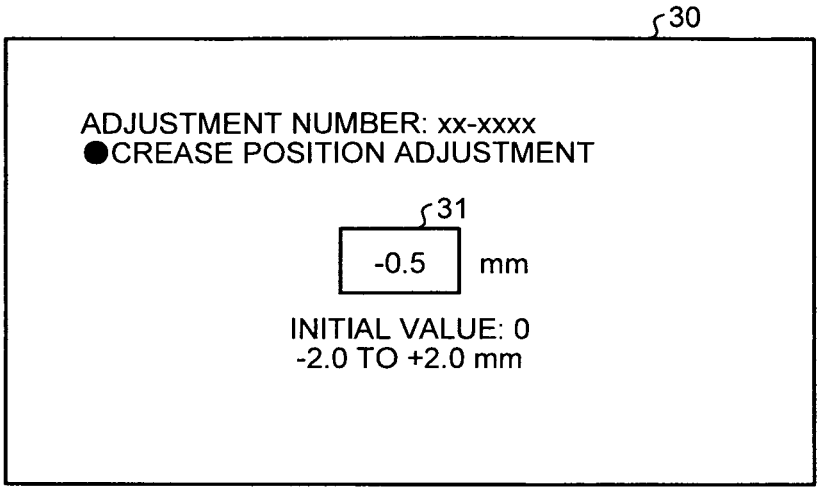
FIG. 18 is a schematic diagram illustrating a crease-position adjustment screen on a control panel.
Figure 19:
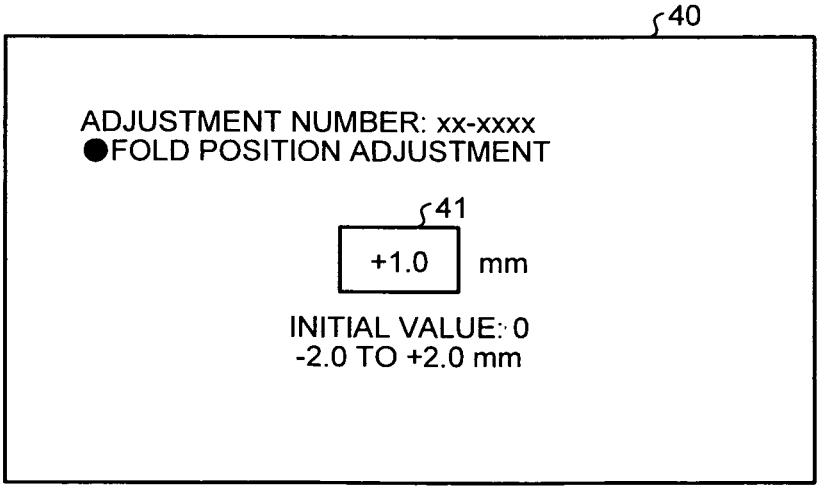
FIG. 19 is a schematic diagram illustrating a fold-position adjustment screen on the control panel.

However, according to the present embodiment, an operator can adjust a crease position (perform crease position adjustment) and a fold position (fold position adjustment) by providing inputs via the control panel 20. FIG. 18 illustrates a crease-position adjustment screen on the control panel 20. FIG. 19 illustrates a fold-position adjustment screen on the same.

With reference to FIG. 18, indications "ADJUSTMENT NUMBER: xx-xxxx" and "CREASE POSITION ADJUSTMENT" are displayed on the crease-position adjustment screen 30 displayed on the control panel 20 with an input box 31 displayed at a center portion of the crease-position adjustment screen 30. In this example, "INITIAL VALUE: 0" and "−2.0 to +2.0 mm", which is an adjustment value, are also displayed below the input box 31. FIG. 18 depicts a situation where "−0.5" has been input to the input box 31.

With reference to FIG. 19, indications "ADJUSTMENT NUMBER: xx-xxxx" and "FOLD POSITION ADJUSTMENT" are displayed on the fold-position adjustment screen 40 with an input box 41 displayed at a center portion of the fold-position adjustment screen 40. In this example, "INITIAL VALUE: 0" and "−2.0 to +2.0 mm", which is an adjustment value, are also displayed below the input box 31 as with the crease-position adjustment screen 30. FIG. 19 depicts a situation where "+1.0" has been input to the input box 31.

Put another way, the screens indicate that crease position adjustment of "−0.5 mm" and fold position adjustment of "+1.0 mm" relative to the initial value are to be performed. When, after the input operations discussed above, an enter key (not shown) is pressed, the crease position and the fold position are adjusted according to the thus-entered adjustment values.

Figure 20:
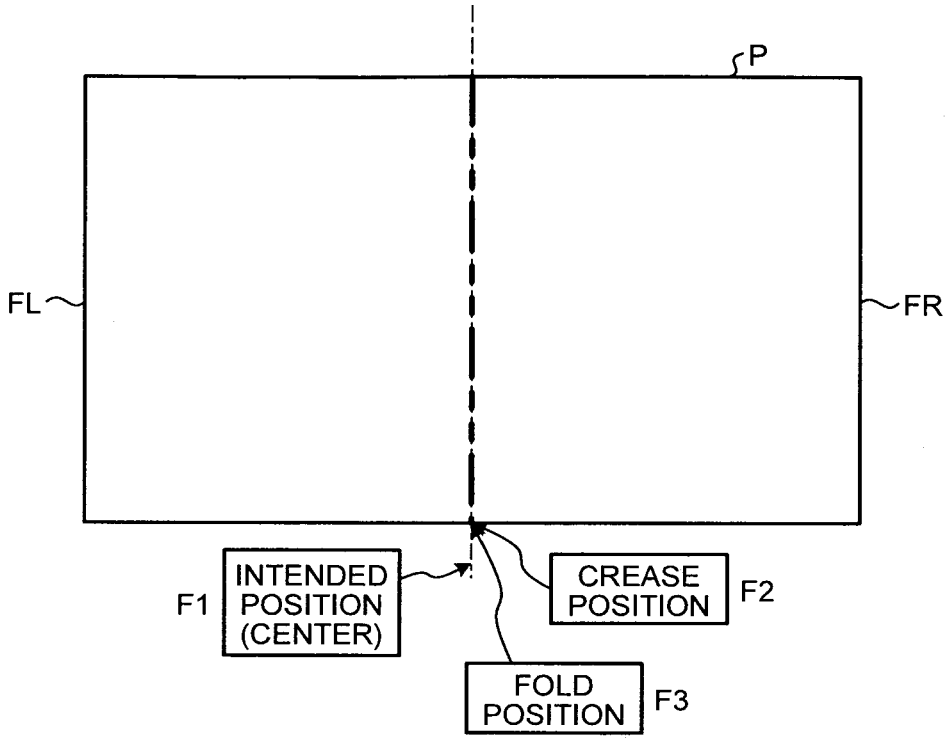
FIG. 20 is a schematic diagram illustrating a relationship between a fold position and a crease position of a sheet having undergone fold position adjustment.
Figure 21:
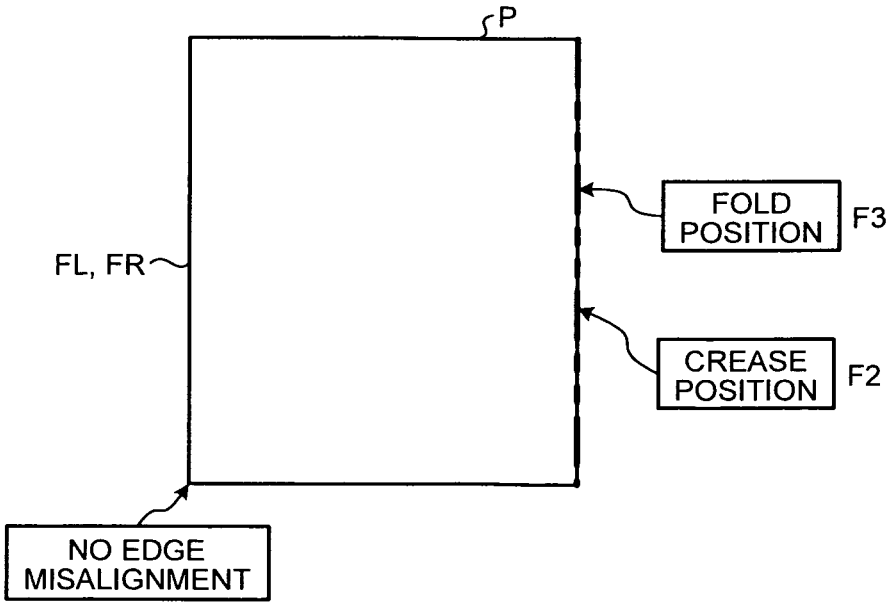
FIG. 21 is a schematic diagram illustrating the sheet of FIG. 20 in a folded state.
Figure 27:
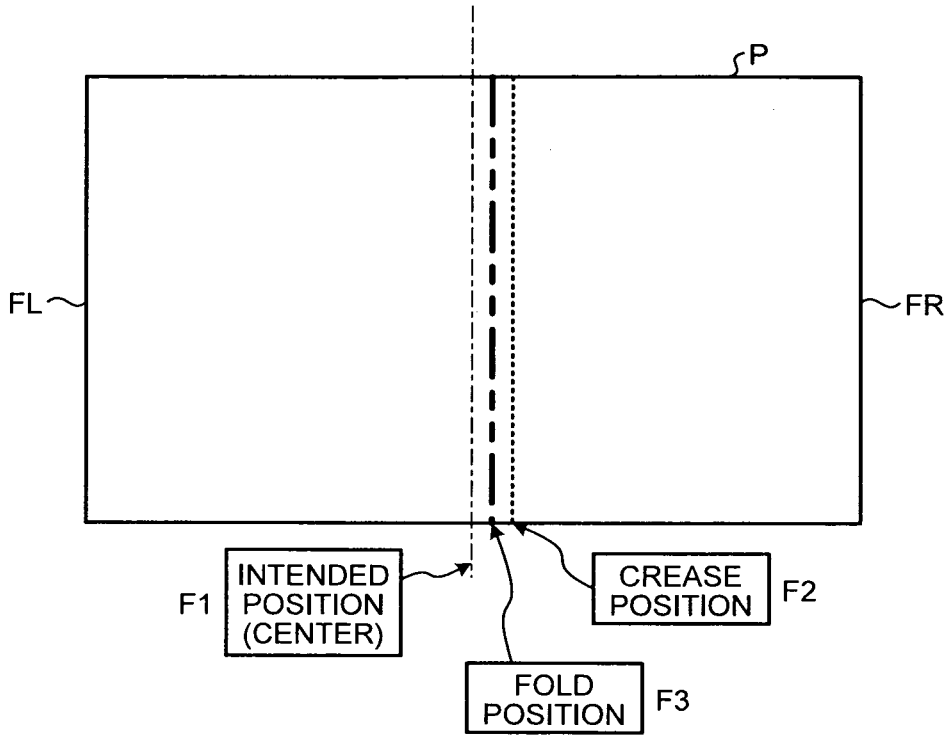
FIG. 27 is a schematic explanatory diagram of a not-yet-folded sheet where a fold position, a crease position, and an intended position depart from one another.
Figure 28:
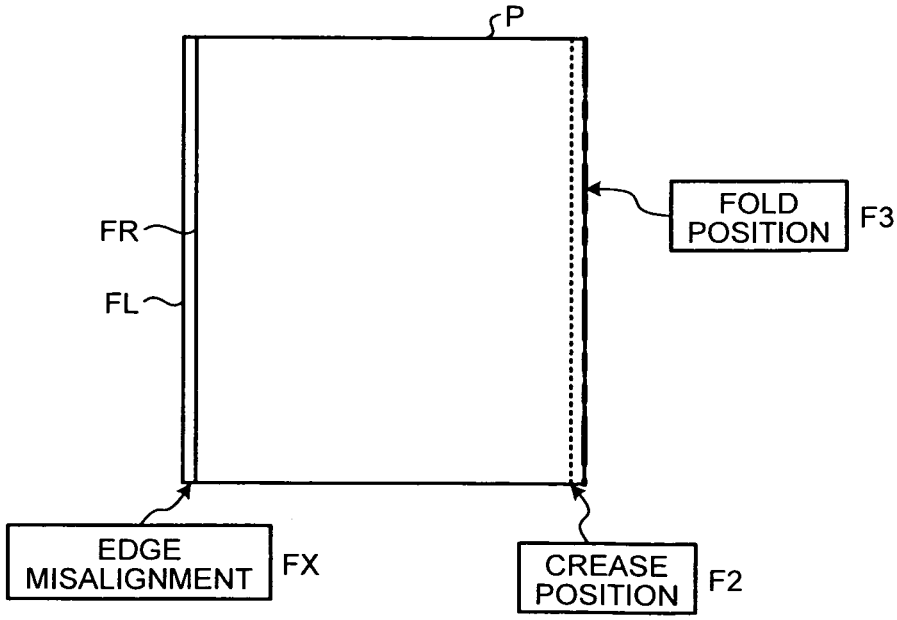
FIG. 28 is a schematic diagram illustrating the sheet of FIG. 27 folded at the intended position.

Put another way, causing the intended position F1, the fold position F3, and the crease position F2 to coincide with one another as illustrated in FIG. 20 and FIG. 21 can be achieved by providing inputs via the control panel 20 for adjusting the crease position (the crease position adjustment) and the fold position (the fold position adjustment) according to amounts of misalignment in the sheet of FIG. 27. FIG. 20 is a schematic diagram illustrating a sheet where the intended position F1, the fold position F3, and the crease position F2 coincide with one another. FIG. 21 is a schematic diagram illustrating the sheet P of FIG. 20 in a folded state.

The crease-position adjustment value and the fold-position adjustment value can be obtained by performing measurement of misalignment between a crease position and the intended position F1 and misalignment between a fold position and the intended position F1 in a first sheet having been creased, folded, and then opened. The intended position F1 is the center of the first sheet. The measured values are input to perform adjustment based on these measured values.

Meanwhile, misalignment can be caused by several possible causes. The causes can be roughly classified into the following two categories below.

1) Variations in installation positions of the sheet detection sensor, the creasing mechanism, the folding mechanism, and the like 2) Dimensional variations specific to individual sheets and dimensional variations (particularly in length in the conveying direction) resulting from expansion and shrinkage during processing Misalignment resulting from a cause in the category 1) can be prevented by performing the adjustment only once because the amount of this misalignment is machine-specific. Misalignment resulting from a cause in the category 2) varies depending on a sheet to be processed and environment.

The dimensional variations in sheets cause the intended position (center position) F1 of the sheet P to vary. This is because sheets P of different length in the longitudinal directions have different center positions.

However, in the present embodiment, the crease position F2 is determined based on a signal output from the sheet entrance sensor S1 on detection of a trailing edge of a sheet. Accordingly, the crease position F2 relative to the trailing edge of the sheet P is maintained constant irrespective of variation in the center position of the sheet P. The fold position F3 relative to the trailing edge is also maintained constant irrespective of variation in the center position of the sheet P because the fold position F3 is determined based on the amount of travel of the trailing-edge fence 11. More specifically, intended positions (center positions) F1 of sheets that vary from each other in dimensions differ from each other. This results in misalignment between the fold position F3 and the intended position F1 and misalignment between the crease position F2 and the intended position F1. However, in the present embodiment, misalignment is prevented because the fold position F3 and the crease position F2 are determined relative to the sheet trailing edge.

Figure 22:
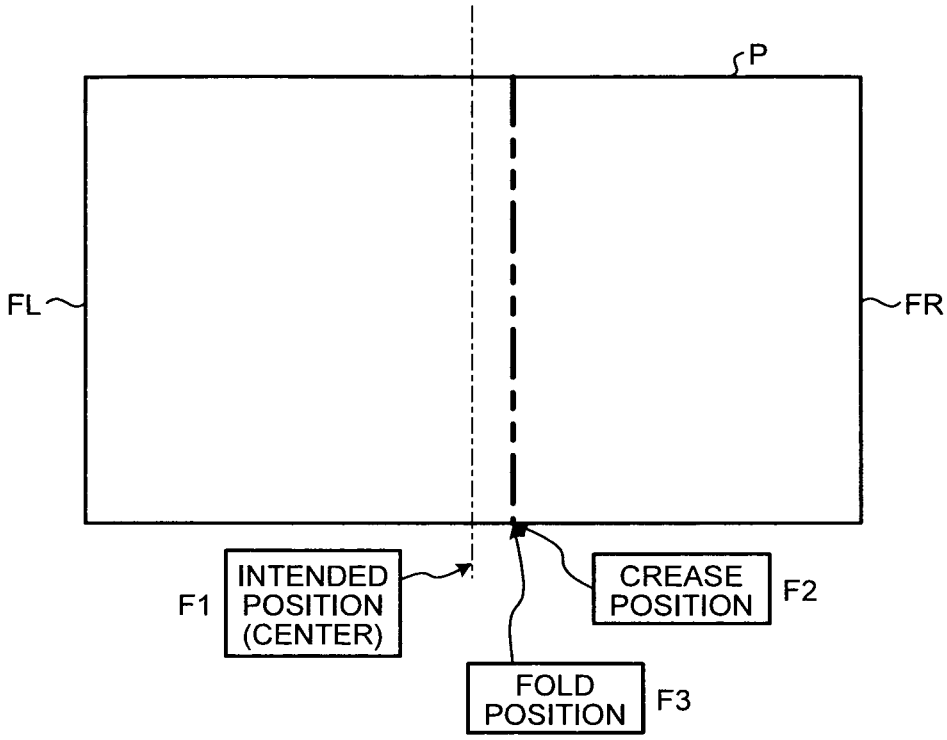
FIG. 22 is a schematic diagram illustrating a not-folded-yet sheet, in which although the fold position and the crease position coincide with each other, the fold position and the crease position depart from an intended position.
Figure 23:
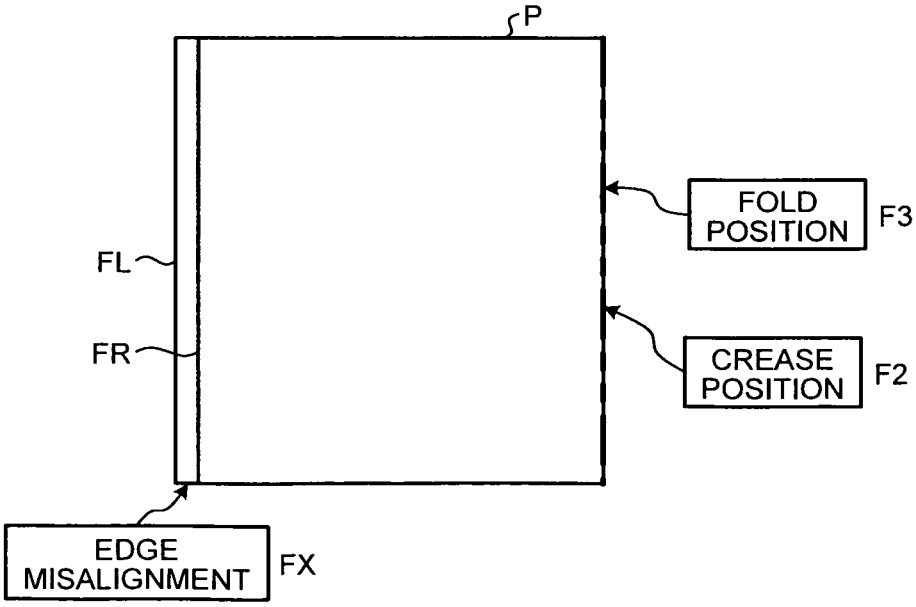
FIG. 23 is a schematic diagram illustrating the sheet of FIG. 22 in a folded state.

Accordingly, once adjustment of the fold position F3 and the crease position F2 has been performed, misalignment between the fold position F3 and the crease position F2 is less likely to occur. However, the intended position F1 can vary depending on dimensions of the sheet. FIG. 22 is a schematic diagram illustrating a not-folded-yet sheet, in which although the fold position F3 and the crease position F2 coincide with each other, the fold position F3 and the crease position F2 depart from the intended position F1. FIG. 23 is a schematic diagram illustrating the sheet illustrated in FIG. 22 in a folded state. As illustrated in FIG. 23, folding the sheet in this state causes the left edge FL and the right edge FR fail to be flush with each other, resulting in the edge misalignment FX.

Figure 24:
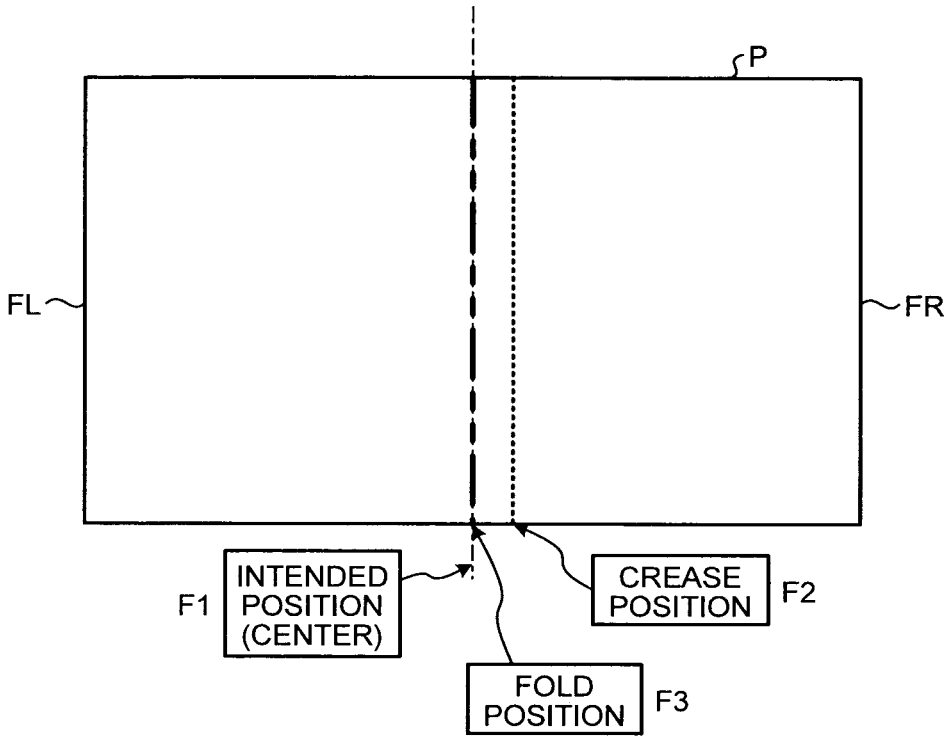
FIG. 24 is a schematic diagram illustrating a sheet having undergone fold position adjustment to thereby have a fold position and a crease position that coincide with each other.
Figure 25:
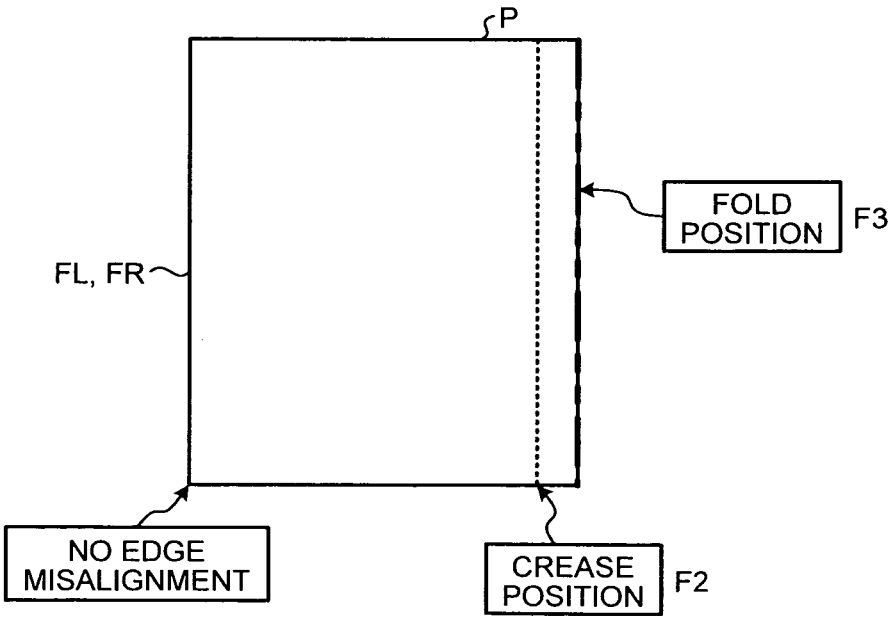
FIG. 25 is a schematic diagram illustrating the sheet of FIG. 24 in a folded state.

When adjustment for the fold position F3 is performed, as illustrated in FIG. 24, the fold position F3 and the intended position F1 coincide with each other. FIG. 25 illustrates the thus-adjusted sheet in a folded state. Subsequently, adjustment for the fold position F3 and thereafter adjustment for the crease position F2 are performed. The resultant sheet has no misalignment as illustrated in FIG. 20 and FIG. 21.

As discussed above, when an edge misalignment occurs in a sheet folded at the intended position F1, it is necessary to perform adjustment for the fold position F3 and adjustment for the crease position F2 individually, which is burdensome for an operator performing these adjustments.

However, in the present embodiment, a function that causes, when the fold position F3 is adjusted, adjustment of the crease position F2 to be performed in synchronization with the adjustment of the fold position F3 is provided. In other words, only by adjusting the fold position F3, the crease position F2 is adjusted in synchronization with the adjustment. Accordingly, only by performing adjustment of the fold position on a sheet that may otherwise have such a misalignment as illustrated in FIG. 22 and FIG. 23, such a sheet as illustrated in FIG. 20 and FIG. 21 where the sheet has no misalignment can be obtained.

When the function that allows the crease position F2 to be adjusted in synchronization with adjustment of the fold position F3 is provided, it is preferable that an operator or a user can select whether to use this function. More specifically, by employing a configuration that allows selection as to whether to adjust the crease position F2 in synchronization with adjustment of the fold position F3 by mode switching, a wide variety of user demands can be satisfied.

Figure 26:
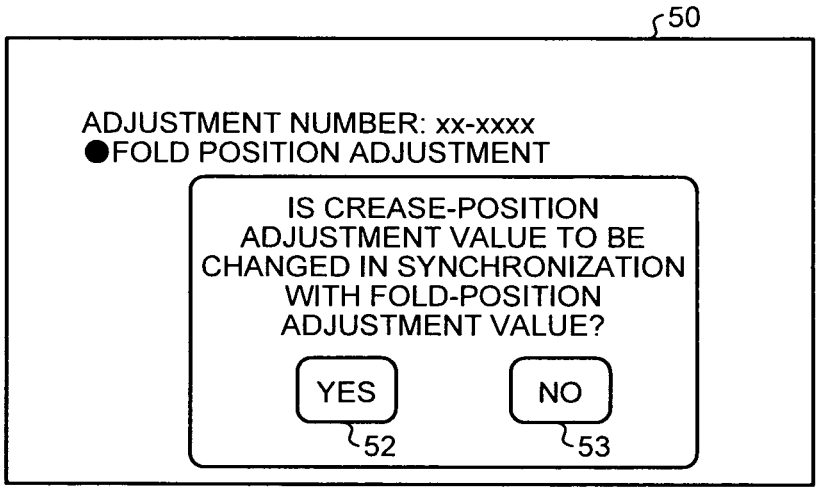
FIG. 26 is a schematic diagram illustrating a selection screen for making a selection as to whether the crease position is to be adjusted in synchronization with adjustment of the fold position.

In the present embodiment, a messages prompting for a selection as to whether the crease position F2 is to be adjusted in synchronization with adjustment of the fold position F3 is displayed on a selection screen 50 on the control panel 20 as illustrated in FIG. 26. By selecting any one of a selection key 52 for "YES" and a selection key 53 for "NO", configuration about whether to adjust the crease position F2 in synchronization with adjustment of the fold position F3 is set.

With this configuration, "YES" can be selected for a situation where it is desired to adjust the crease position F2 in synchronization with adjustment of the fold position F3, while "NO" can be selected for a situation where it is desired to adjust the crease position F2 and the fold position F3 individually.

In the present embodiment, the control panel 20 of the image forming apparatus PR is used as an input device for an operator; alternatively, the folding device B can include a control panel so that an input is provided via the control panel. By using a control panel provided in an image forming system, in which a plurality of post-processing devices are connected in line along a sheet conveying direction and these devices forms a single system and configured as illustrated in FIG. 18, FIG. 19, and FIG. 26, control operations for causing the fold position F3, the crease position F2, and the intended position F1 to coincide with each other can be performed easily.

As discussed above, according to the present embodiment, adjustment of the fold position F3 and adjustment of the crease position F2 can be performed concurrently in synchronization with adjustment of the fold position F3. This facilitates adjustment of the crease position F2 and the fold position F3 with a relatively small number of operations.

According to an aspect of the present embodiment, when a fold position is adjusted by a fold-position-adjustment-amount input unit, a crease position is also adjusted according to the adjustment of the fold position. Accordingly, not only adjustment between the crease position and the fold position but also adjustment of the crease position and the fold position relative to a predetermined position can be performed only by adjusting the fold position.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming system, comprising:

a folding unit that folds a sheet of paper to form a fold in the sheet;

a creasing unit that, before the sheet is folded, produces a crease in the sheet at a fold position where the fold is to be formed;

a crease-position adjusting unit that adjusts a crease position where the crease is to be produced;

a fold-position adjusting unit that adjusts the fold position;

a first input unit that receives an input specifying an amount, by which the crease position is to be adjusted; and a second input unit that receives an input specifying an amount, by which the fold position is to be adjusted, wherein:

in a first mode, when the fold position is adjusted by the second input unit, the crease position is also adjusted in synchronization with the adjustment of the fold position, and in a second mode, when the fold position is adjusted by the second input unit, only the adjustment of the fold position is performed.

2. The image forming system according to claim 1, further comprising a selecting unit for selecting any one of the first mode and the second mode when the fold position is adjusted by the second input unit.

3. The image forming system according to claim 1, wherein when the crease position is adjusted by the crease-position adjusting unit, only the adjustment of the crease position is performed.

4. The image forming system according to claim 1, wherein the first input unit and the second input unit include an operating screen.

5. The image forming system according to claim 4, wherein the operating screen is a control panel of an image forming apparatus.

6. The image forming system according to claim 4, wherein the operating screen is the control panel of a folding device including the folding unit.

7. The image forming system according to claim 4, wherein the first input unit and the second input unit include an information communications unit for receiving an information.

8. The image forming system according to claim 1, further comprising an operating unit, wherein the selecting unit includes an operating screen, and any one of the first mode and the second mode is to be selected by making selection from the operating screen.

9. A sheet finisher, comprising:

a folding unit that folds a sheet of paper to form a fold in the sheet;

a creasing unit that, before the sheet is folded, produces a crease in the sheet at a fold position where the fold is to be formed;

a crease-position adjusting unit that adjusts a crease position where the crease is to be produced;

a fold-position adjusting unit that adjusts the fold position;

a first input unit that receives an input specifying an amount, by which the crease position is to be adjusted; and a second input unit that receives an input specifying an amount, by which the fold position is to be adjusted, wherein:

in a first mode, when the fold position is adjusted by the second input unit, the crease position is also adjusted in synchronization with the adjustment of the fold position, and in a second mode, when the fold position is adjusted by the second input unit, only the adjustment of the fold position is performed.

10. The sheet finisher according to claim 9, wherein the first input unit and the second input unit are configured to an operating screen.

* * * * *